US008875561B2

(12) United States Patent
Worden et al.

(10) Patent No.: US 8,875,561 B2
(45) Date of Patent: Nov. 4, 2014

(54) SYSTEMS AND METHODS FOR DIAGNOSING AN ENGINE

(75) Inventors: Bret Dwayne Worden, Erie, PA (US); Milan Karunaratne, Lawrence Park, PA (US); Benedict George Lander, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 218 days.

(21) Appl. No.: 13/233,809

(22) Filed: Sep. 15, 2011

(65) Prior Publication Data

US 2013/0067994 A1 Mar. 21, 2013

(51) Int. Cl.
*G01M 3/04* (2006.01)

(52) U.S. Cl.
USPC ..... 73/40

(58) Field of Classification Search
None
See application file for complete search history.

(56) References Cited

U.S. PATENT DOCUMENTS

| | | | | |
|---|---|---|---|---|
| 4,235,100 | A | 11/1980 | Branchini | |
| 4,334,427 | A | 6/1982 | Armstrong | |
| 5,105,653 | A | 4/1992 | Konter | |
| 5,216,915 | A | 6/1993 | Sakamoto | |
| 5,324,114 | A * | 6/1994 | Vinci | 73/756 |
| 5,711,272 | A | 1/1998 | Maegawa et al. | |
| 5,728,941 | A | 3/1998 | Yamamoto et al. | |
| 5,860,800 | A | 1/1999 | Kramer et al. | |
| 5,996,400 | A * | 12/1999 | Nishioka et al. | 73/40.5 R |
| 6,023,651 | A | 2/2000 | Nakayama et al. | |
| 6,510,731 | B2 | 1/2003 | Schricker et al. | |
| 6,658,346 | B2 | 12/2003 | Maegawa | |
| 6,968,268 | B2 | 11/2005 | Yamada et al. | |
| 7,000,467 | B2 * | 2/2006 | Chu et al. | 73/299 |
| 7,133,766 | B2 | 11/2006 | Kokubo | |
| 7,197,916 | B2 | 4/2007 | Matsumoto et al. | |
| 7,761,223 | B2 | 7/2010 | Wang et al. | |

(Continued)

FOREIGN PATENT DOCUMENTS

| | | | |
|---|---|---|---|
| EP | 0522849 | A1 | 7/1991 |
| EP | 1357272 | A1 | 10/2003 |
| EP | 1544433 | A1 | 6/2005 |

OTHER PUBLICATIONS

U.S. Appl. No. 13/047,200, filed Mar. 14, 2011.

(Continued)

*Primary Examiner* — Peter Macchiarolo
*Assistant Examiner* — Alex Devito
(74) *Attorney, Agent, or Firm* — GE Global Patent Operation; John A. Kramer

(57) ABSTRACT

Presently disclosed are methods and systems for diagnosing a coolant leak of an engine. A method may include diagnosing a coolant leak of an engine based on identified fill signatures of a measured engine coolant pressure. A vehicle system is also disclosed, including an engine, a coolant system operatively connected to the engine, a coolant pressure sensor configured to measure engine coolant pressure during operation of the engine, and a controller, including instructions configured to create a coolant pressure profile corresponding to a given engine speed, and diagnose a condition of the engine based on the coolant pressure profile.

23 Claims, 4 Drawing Sheets

(56) References Cited

U.S. PATENT DOCUMENTS

| | | | | |
|---|---|---|---|---|
| 2002/0050271 | A1 | 5/2002 | Hasegawa et al. | |
| 2002/0112528 | A1* | 8/2002 | Antonioli et al. | 73/49.7 |
| 2003/0189051 | A1 | 10/2003 | Liu | |
| 2004/0148926 | A1 | 8/2004 | Morinaga et al. | |
| 2005/0204805 | A1 | 9/2005 | Wakahara et al. | |
| 2007/0240434 | A1* | 10/2007 | Allen et al. | 62/129 |
| 2009/0120174 | A1 | 5/2009 | Nodera et al. | |
| 2009/0229355 | A1 | 9/2009 | Shoda | |
| 2010/0162797 | A1 | 7/2010 | Summers et al. | |
| 2010/0211296 | A1 | 8/2010 | Saunders | |

OTHER PUBLICATIONS

Search Report and Written Opinion from corresponding PCT Application No. PCT/US2012/053512 dated Apr. 18, 2013.

International Preliminary Report on Patentability from corresponding PCT Application No. PCT/US2012/053512 dated Mar. 18, 2014.

* cited by examiner

SYSTEMS AND METHODS FOR DIAGNOSING AN ENGINE

TECHNICAL FIELD

The present disclosure relates to systems and methods for diagnosing an engine, and more particularly to systems and methods for diagnosing a coolant leak based on a measured coolant pressure.

BACKGROUND

Coolant leaks have long been a major contributor to engine shutdowns or degradation of engine components operated at undesirably high temperatures. In some applications, when the coolant level falls below a critical level, the engine will derate power and then shut off to protect itself from overheating. This unexpected shutdown causes delay, and for vehicle systems may interfere with other traffic. If an engine is allowed to run without proper cooling, damage to the engine could occur resulting in expensive and time consuming repairs. At present, there remains a need for adaptive or threshold based methods and systems to detect the presence of coolant leaks in engines before engine coolant falls below a critical level.

BRIEF DESCRIPTION

In one embodiment, a method for an engine including a coolant pump is provided. The method includes diagnosing a coolant leak of an engine based on identified fill signatures of a measured engine coolant pressure.

In another embodiment, a method for an engine including a coolant pump is provided that includes measuring an engine coolant pressure over time, measuring a rotational speed of the engine over time, correlating the measured engine coolant pressure and the measured rotational speed to identify a coolant pressure profile at a selected rotational speed, and diagnosing a coolant leak of the engine based on the coolant pressure profile.

In one embodiment, a vehicle system is provided. The vehicle system includes an engine, a coolant system operatively connected to the engine, a coolant pressure sensor configured to measure engine coolant pressure during operation of the engine, and a controller, including instructions configured to create a coolant pressure profile corresponding to a given engine speed, and diagnose a condition of the engine based on the coolant pressure profile.

This brief description is provided to introduce a selection of concepts in a simplified form that are further described herein. This brief description is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

The invention will be understood from reading the following description of non-limiting embodiments, with reference to the attached drawings, wherein below.

DETAILED DESCRIPTION

Embodiments of the subject matter disclosed herein relate to systems and methods for diagnosing an engine. Test kits for performing the methods are provided, also. The engine may be included in a vehicle, such as a locomotive system. Other suitable types of vehicles may include on-highway vehicles, off-highway vehicles, mining equipment, aircraft, and marine vessels. Other embodiments of the invention may be used for stationary engines, such as wind turbines or power generators. The engine may be a diesel engine, or may combust another fuel or combination of fuels. Such alternative fuels may include gasoline, kerosene, biodiesel, natural gas, and ethanol—as well as combinations of the foregoing. Suitable engines may use compression ignition and/or spark ignition. The engines may also be in fluid communication with a coolant system of the vehicle. The coolant system may be pressurized. These vehicles may include an engine with components that degrade with use.

Furthermore, embodiments of the subject matter disclosed herein use data, such as measured coolant pressure, to diagnose conditions of an engine or auxiliary equipment and to distinguish between conditions of the engine or coolant system. Some embodiments diagnose a coolant leak of an engine based on identified fill signatures of a measured engine coolant pressure.

An engine may be put in a particular operating condition or mode when looking for particular types of engine degradation or measuring coolant pressure. For example, the engine may be diagnosed during a self-loaded condition as part of a test procedure, a dynamic brake (db) setup condition, or a steady state motoring condition. The diagnostic and prognostic methods discussed herein can be used for trending, comparing conditions over time, performing test procedures, repair confirmation, and aid in repair. In some embodiments, coolant pressure data may be sampled when the engine reaches a particular operating condition or state during normal operation.

Figure 1:
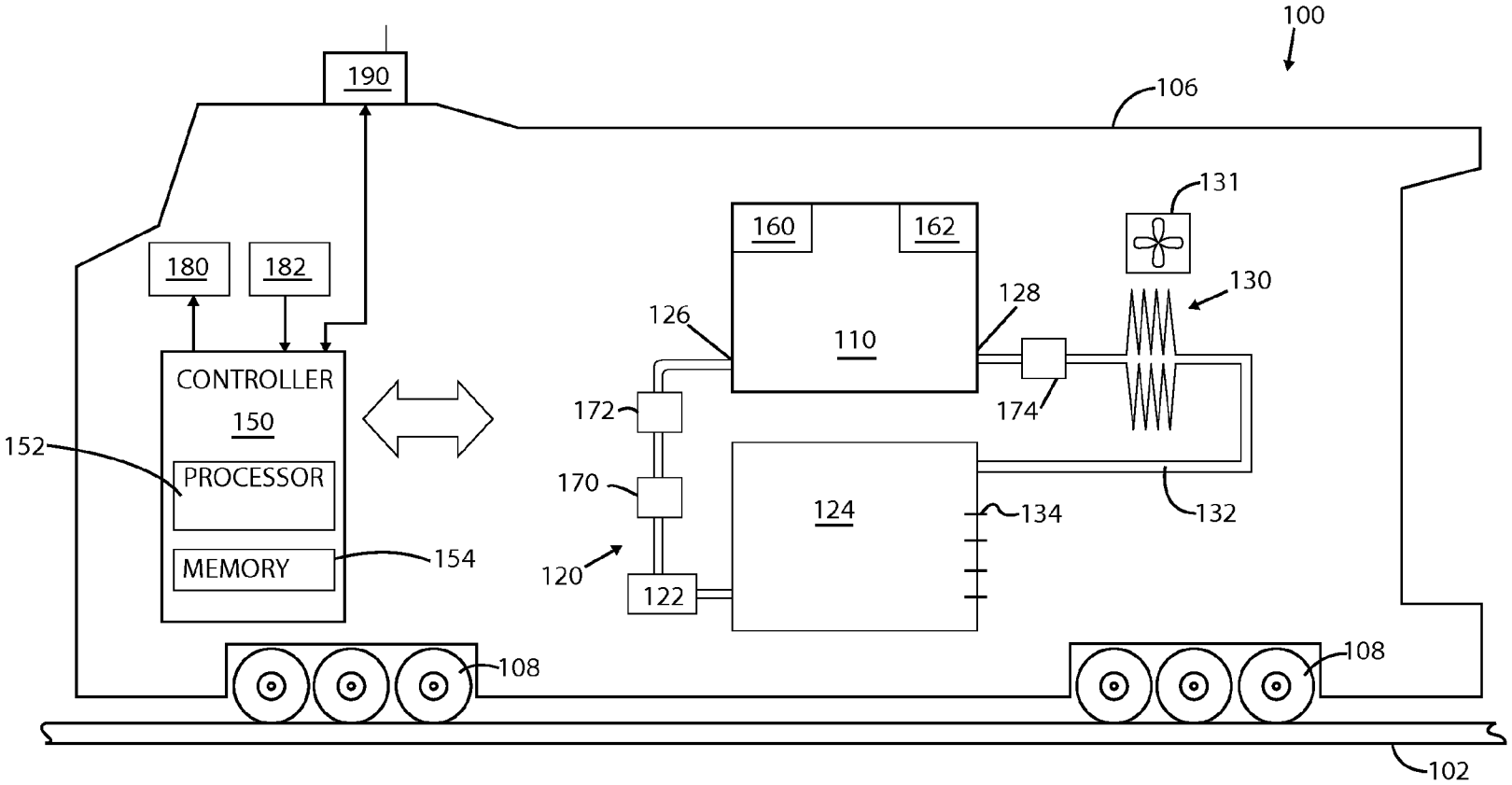
FIG. 1 is an illustration of an example embodiment of a vehicle system (e.g., a locomotive system), having an engine and a coolant system, herein depicted as a rail vehicle configured to run on a rail via a plurality of wheels.

FIG. 1 is an illustration of an example embodiment of a vehicle system 100 (e.g., a locomotive system) herein depicted as a rail vehicle 106 configured to run on a rail 102 via a plurality of wheels 108. As depicted, the rail vehicle 106 includes an engine 110 operatively connected to a coolant system 120. The vehicle 106 further includes various auxiliary systems or equipment operatively connected to a generator (not shown) or the engine 110 for performing various functions.

The vehicle 106 further includes a controller 150 to control various components related to the vehicle system 100. In one example, controller 150 includes a computer control system. In one embodiment, the computer control system is largely software-based and includes a processor, such as processor 152, configured to execute computer operable instructions. The controller 150 may include multiple engine control units (ECU) and the control system may be distributed among each of the ECUs. The controller 150 further includes computer readable storage media, such as memory 154, including instructions (e.g., computer executable instructions) for enabling on-board monitoring and control of rail vehicle operation. Memory 154 may include volatile and non-volatile memory storage. In accordance with another embodiment, the controller may be hardware-based using, for example, digital signal processors (DSPs) or other hardware logic circuitry to perform the various functions described herein.

The controller may oversee control and management of the vehicle system 100. The controller may receive a signal from a speed sensor 160 of the engine, from an engine inlet coolant pressure sensor 170, or from various other sensors through the vehicle system 100 to determine operating parameters and operating conditions. For example, the controller 150 may also receive a signal from an engine coolant inlet temperatures sensor 172 and an engine coolant outlet temperature sensor 174. Correspondingly, the controller may control the vehicle system 100 by sending commands to adjust various engine actuators 162 to control operation of the rail vehicle 106, including various components such as traction motors, alternator, cylinder valves, throttle, and a coolant pump 122. Signals from various sensors may be bundled together into one or more wiring harnesses to reduce space in the vehicle system 100 devoted to wiring and to protect the signal wires from abrasion and vibration.

The controller may include onboard electronic diagnostics for recording operational characteristics of the engine. Operational characteristics may include measurements from the speed sensor 160, the coolant pressure sensor 170, and/or the temperature sensors, for example. In one embodiment, the operational characteristics may be stored in a database in memory 154. In one embodiment, current operational characteristics may be compared to past operational characteristics to determine trends of engine performance.

The controller may include onboard electronic diagnostics for identifying and recording potential degradation and failures of components of the vehicle system 100. One condition that may be diagnosed is a coolant leak from the coolant system 120. For example, when a coolant leak is identified, a diagnostic code may be stored in a memory 154. In one embodiment, a unique diagnostic code may correspond to each condition that may be identified by the controller. For example, a first diagnostic code may indicate a measured coolant pressure below a threshold corresponding to a warning level, a second diagnostic code may indicate a problem with the coolant pump 122, a third diagnostic code may indicate a problem with the coolant level sensors 134, etc. . . . .

The controller may be further linked to a display 180, such as a diagnostic interface display, providing a user interface to the locomotive operating crew and a maintenance crew. The controller may control the engine in response to operator input via user input controls 182, by sending a command to correspondingly adjust various engine actuators 162. Non-limiting examples of user input controls 182 may include a throttle control, a braking control, a keyboard, and a power switch. Further, operational characteristics of the engine and auxiliary equipment, such as diagnostic codes corresponding to degraded components, may be reported via display 180 to the operator and/or the maintenance crew.

The vehicle system may include a communications system 190 linked to the controller. In one embodiment, communications system 190 may include a radio and an antenna for transmitting and receiving voice and data messages. For example, data communications may be between the vehicle system and a control center of a railroad, another locomotive, a satellite, and/or a wayside device, such as a railroad switch. For example, the controller may estimate geographic coordinates of the vehicle system using signals from a GPS receiver. As another example, the controller may transmit operational characteristics of the engine and/or auxiliary equipment to the control center via a message transmitted from communications system 190. In one embodiment, a message may be transmitted to a command center by communications system 190 when a coolant leak of the engine is detected and the vehicle system may be scheduled for maintenance.

Various auxiliary equipment may be operatively coupled to and driven by a rotating engine shaft. Other auxiliary equipment are driven by an engine-driven generator. Examples of such auxiliary equipment include a blower, a compressor, and a radiator fan 131. In accordance with certain embodiments, the generator may actually be one or more generators, such as, for example, a main generator to drive the traction motors and an auxiliary generator to drive a portion of the auxiliary equipment. Further examples of auxiliary equipment include turbochargers, pumps, and engine cooling systems.

The vehicle system 100 includes a coolant system 120 operatively connected to the engine 110. The coolant system 120 is in fluid communication with the engine allowing coolant to flow through the engine and to the radiator 130 to dissipate heat. The coolant may be water or other commercially available coolants. In certain embodiments, the coolant system 120 includes a coolant pump 122. The coolant pump 122 may be mechanically driven from the rotating shaft of the engine 110. Alternatively, the coolant pump 122 may be electrically driven from a generator or an alternator of the vehicle system. The coolant pump 122 pumps coolant through the engine. The pressure of the coolant entering the engine at the inlet port 126 is measured by the coolant pressure sensor 170. Other coolant pressure sensors may be provided throughout the engine coolant system, such as within the engine or near the engine outlet port 128. In one embodiment, coolant pumped by coolant pump 122 enters the engine at the inlet port 126, circulates through the engine, and exits the engine at the outlet port 128. The inlet port 126 and the outlet port 128 may be ports on an engine block or other portion of the engine adapted for the passage of coolant. The coolant passing through the engine may absorb heat from the engine and carry the heat out of the engine to the radiator 130 where the heat is dissipated to the surrounding environment. In some embodiments, a radiator fan 131 is provided to increase air flow across the radiator 130, thereby increasing the cooling of the coolant passing through the radiator. The coolant may exit the radiator and flow through a return path 132 to a coolant reserve 124. The coolant reserve 124 may be a reservoir provided to store coolant allowing for thermal expansion and contraction. In some embodiments, the coolant reserve 124 may be a tank or an enlarged section of piping. In some embodiments, the coolant system 120 forms a closed circuit in which the coolant is pressurized by pump 122.

The vehicle system 100 may include one or more sensors configured to monitor conditions in the system. For example, the speed sensor 160 measures the speed of the rotating shaft of the engine during operation. The coolant pressure sensor 170 measures the pressure of the coolant in the engine coolant system 120. The coolant pressure may be measured at the coolant pump 122, between the coolant pump and the engine, or within the engine. One or more coolant pressure sensors may be provided at different locations to measure the coolant pressure. The coolant level sensor 134 measures the coolant level in the coolant reserve 124. In some embodiments, the coolant level sensor 134 may be one or more refraction sensors. In other embodiments, the coolant level sensor 134 may be a float level sensor. Suitable commercially available sensors may be selected based on application specific parameters.

Figure 2:
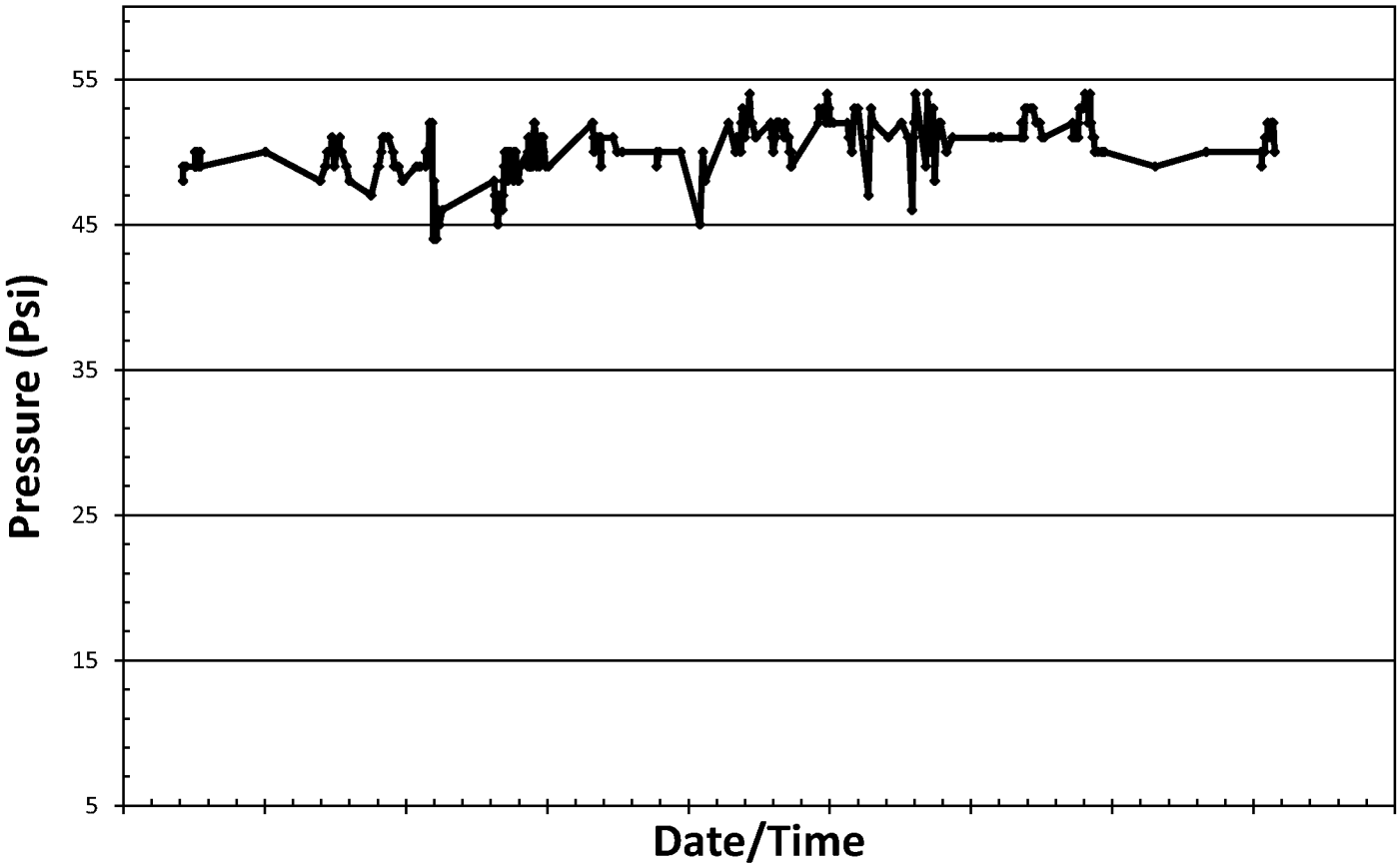
FIG. 2 is an illustration of an example embodiment of measured coolant pressure of an engine.

Referring to FIG. 2, a measured engine inlet coolant pressure is shown over time for an engine operating at 1050 RPM without a coolant leak. For this engine operating at 1050 RPM, the coolant pressure is expected to be between 45 psi and 55 psi under standard operating conditions. As shown, the measured coolant pressure fluctuates within the standard pressure range, and does not exhibit large excursions outside this ranges. At a constant engine speed, engine coolant pressure is generally proportional to the level of coolant in the coolant system and thus this graph reflects a generally constant coolant level. For analysis purposes, a running average of the measured coolant pressure may be utilized to compensate for this type of expected fluctuation in the measured data.

Figure 3:
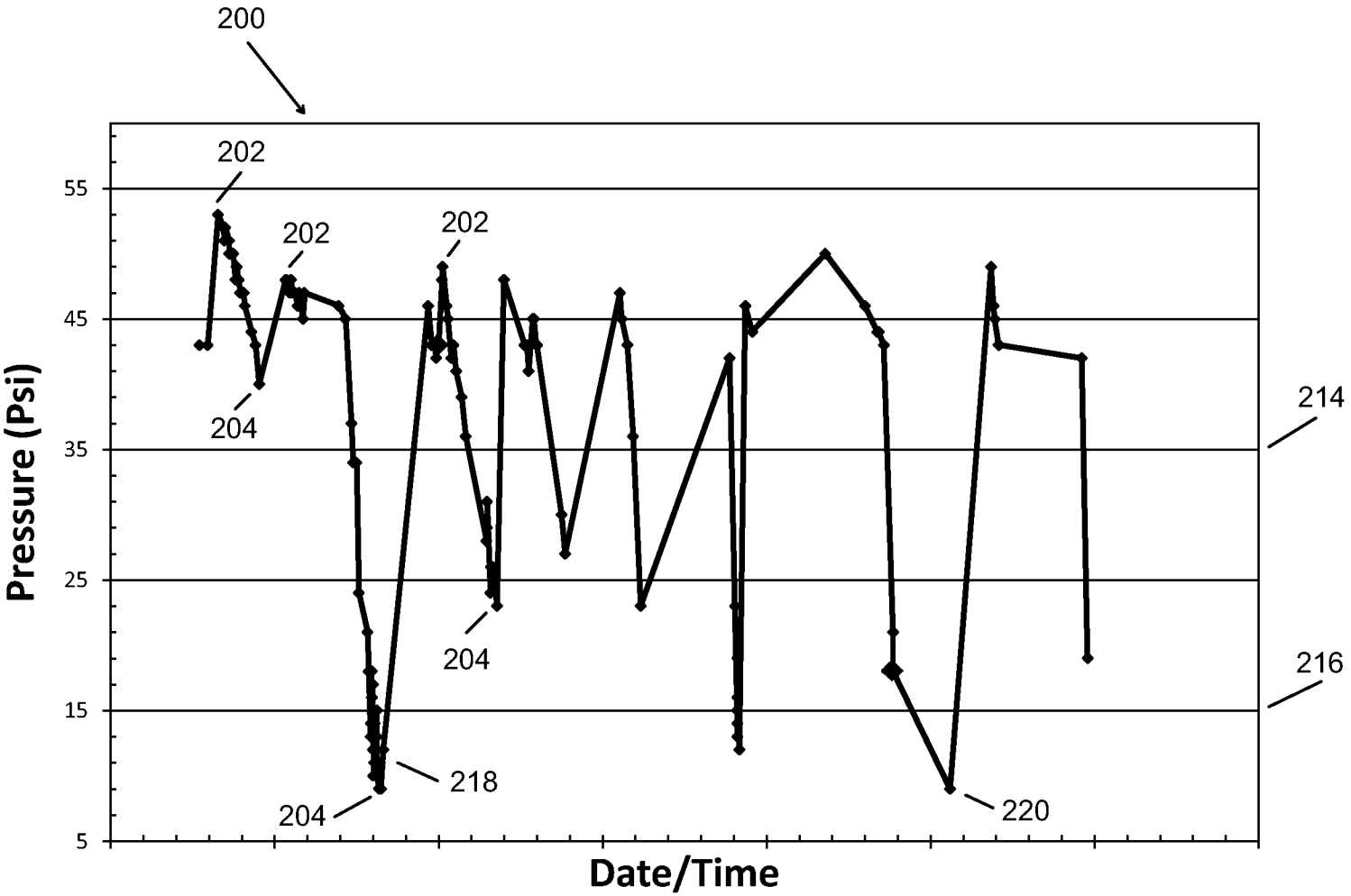
FIG. 3 is an illustration of an example embodiment of measured coolant pressure of an engine with a coolant leak.

In contrast, a measured engine inlet coolant pressure 200 is shown over time for an engine with a coolant leak in FIG. 3. As in FIG. 2, the measured coolant pressure is depicted for the engine operating at 1050 RPM, and the standard pressure condition is between and including 45 psi and 55 psi. The repeated peaks 202 and troughs 204 in the measured coolant pressure at a constant engine speed or coolant pump operating speed signify that coolant is being depleted and periodically added to the system. In this embodiment, a low pressure warning level 214 may be defined at 35 psi. A low pressure critical level 216 may be defined at 15 psi. When the measured coolant pressure 200 falls below the warning level 214, an alert may be generated notifying the operator of the low pressure condition. The alert may also be communicated via the communications system 190 to a control center or other monitoring location. The low pressure condition may further be recorded in memory 154 associated with a diagnostic code for use by service personnel. When the measured coolant pressure 200 falls below the critical level 216, the engine power may be derated or the engine may be shut down to prevent further damage. An engine derating 218 and an engine shutdown 220 resulting in a road failure occurred when the coolant pressure fell below the critical level 216 as shown in FIG. 3. The decision to derate, shutdown, or continue operating when the coolant pressure is outside the standard pressure range may be made by the operator or the system based on one or more factors, such as, the measured pressures and temperatures within the engine.

In accordance with an embodiment, the coolant pump 122 is driven by the engine 110 such that engine inlet coolant pressure is a function of both engine speed and the amount of coolant in the coolant system 120. To compensate for the effect of engine speed on the measured coolant pressure, the engine may first be driven to a specified operating speed before the coolant pressure is measured by the coolant sensor. Alternatively, the coolant pressure sensor 170 may periodically or continuously measure the coolant pressure and the measured coolant pressure data may be correlated with data representing the rotational speed of the engine to create a coolant pressure profile at a given engine speed. The rotational speed of the engine may be measured by the engine speed sensor 160, or may be inferred from the engine controls, such as the throttle setting. In one embodiment, two or more coolant pressure profiles may be created from the measured speed and pressure data, where each coolant pressure profile corresponds to a different engine speed. In this manner, the coolant pressure may be analyzed across different operating conditions, such as at idle, low speed, and high speed operations. In another embodiment, the controller 150 receives the measured speed and pressure data and includes instructions configured to create a coolant pressure profile corresponding to a given engine speed. In yet another embodiment, the engine coolant pressure may be sampled at a specified operating speed of the engine. For example, the controller 150 may include instructions configured to collect data from the coolant pressure sensor 170 only when the engine is operating at a given speed. In each embodiment, the coolant pressure profile may be determined from the measured coolant pressure data for a given engine speed, and both represent the coolant pressure data being analyzed in various embodiments.

When the coolant pump 122 is driven by the engine 110, the operating speed of the coolant pump 122 may be proportional to the engine speed. In other embodiments, the coolant pump 122 may be configured such that the operating speed of the coolant pump 122 is not proportional to the engine speed. For example, the coolant pump 122 may be electrically powered from an electrical source, such as the battery, generator, or alternator of the engine. In some stationary applications, the coolant pump 122 may be electrically powered by an external power source, such as an electrical utility. In some embodiments, the operating speed of the coolant pump 122 may be controllable separate from the engine rotational speed, and the coolant pressure may be a function of at least the coolant pump operating speed and the coolant level in the system. In these embodiments, the measured coolant pressure may be correlated with the operating speed of the coolant pump or sampled at a given operating speed of the coolant pump to create a coolant pressure profile.

In accordance with an embodiment, an identified fill signature of a measured engine coolant pressure is used to diagnose a coolant leak of the engine 110. A fill signature may be characterized as a portion of the measured coolant pressure data indicating that coolant has been added to the coolant system, i.e., that the coolant system has been refilled. In various embodiments, the identification of a fill signature may trigger a warning or alarm prompting maintenance of the system. In some embodiments, a count of the identified fill signatures may be maintained and used to determine when maintenance or repair is needed.

In some embodiments, a fill signature may be defined as the measured coolant pressure being no more than a first pressure threshold for at least a first duration followed by the measured pressure being no less than a second pressure threshold for a second duration, where the second pressure threshold is greater than the first pressure threshold. For example, a fill signature may be defined as the measured coolant pressure being less than or equal to 35 psi for at least 60 seconds, followed by the measured coolant pressure being greater or equal to 45 psi for at least 60 seconds. In some embodiments, the first pressure threshold may correspond to a low pressure warning level 214, while the second pressure threshold corresponds to a lower limit of a standard pressure range. Because the coolant system may not be fully refilled during each fill operation, the second pressure threshold may be set lower than the lower limit of the standard pressure range to identify fill signatures corresponding to a partial refill of the coolant.

In another embodiment, a fill signature may be defined as identifying a measured low pressure condition prior to a measured standard pressure condition. The low pressure condition may be the measured coolant pressure being no more than a low pressure threshold, while the standard pressure condition may be the measured coolant pressure being within a desired operating range for the engine, such as within a specified pressure range for the engine under a selected set of operating conditions. Referring to FIG. 3, in one example, the lower pressure condition may be a coolant pressure less than or equal to 35 psi. The standard pressure condition may be a coolant pressure of at least 45 psi and no more than 55 psi, where this range is the desired operating pressure of the engine when the engine and/or cooling pump are operating at a given speed. In other embodiments, the low pressure and standard pressure conditions may be selected as appropriate to the engine and operating speeds desired.

In yet another embodiment, a fill signature may be defined as detecting a rate of change of the measured engine coolant pressure equal to or exceeding a predetermined threshold. When coolant is added to the coolant system 120, the measured coolant pressure at a given engine speed may increase. When the measured coolant pressure is analyzed, the increase between the measured coolant pressure before the addition of coolant and the measured coolant pressure after the additional of coolant may be identified as the rate of change of the coolant pressure. When the measured coolant data is sampled or correlated with engine speed, adjacent data points in the measured coolant pressure may not correspond to adjacent measurements in time. As such, the rate of change may be computed as the rate of change between subsequent data points, rather than a rate of change over a time interval. In one example, the changes between adjacent coolant pressure measurements may be at least 10 psi, at least 15 psi or at least 25 psi. The coolant pressure data may also be filtered or averaged to remove normal fluctuation and the rate of change of the averaged coolant pressure data may be compared to the predetermined threshold to identify a fill signature.

In some embodiments, the fill signature may be defined as a sequence of alternating peaks 202 and troughs 204, such as illustrated in FIG. 3. The peaks and troughs of the measured coolant pressure or coolant pressure profile may be identified as local minima or local maxima in the measured coolant pressure. In various embodiments, the measured coolant pressure data may be averaged, filtered, or otherwise processed to assist with the identification of the peaks 202 and troughs 204. As illustrated, each peak 202 and trough 204 may have a different value, and the different between adjacent peaks 202 and troughs 204 may be different.

In yet other embodiments, diagnosing a coolant leak of the engine includes identifying a decreasing coolant pressure trend of the coolant pressure profile. As shown in FIG. 3, the measured coolant pressure decreased prior to each increase in the measured pressure that corresponds to the refilling of the coolant. A decreasing coolant pressure for a minimum duration defining a trend may be identified and correlated with a leak of the coolant system 120. The minimum duration may be determined for each application based upon the normal maintenance schedule for the engine or vehicle. For example, the minimum duration may be measured in hours, such as 1 hour, 4 hours, or 12 hours, or may be measured in days, such as 3 days, 7 days, or even longer in some applications. Additionally, to compensate for normal fluctuations, the coolant pressure profile may be averaged or filtered to remove short term variation. In some embodiments, a decreasing coolant pressure trend may be identified prior to a fill signature providing advance detection of a coolant leak and allowing for preventative maintenance to be scheduled. In some embodiments, the decreasing pressure trend may be characterized as a leak signature and may be detected using methods comparable to those used to identify fill signatures as described above.

In general, in accordance with various embodiments, a fill signature or leak signature may be identified using one or more of the methods disclosed, including combinations of the methods. Additionally, a condition of an engine can be diagnosed based on a combination of measured parameters from the engine. In some embodiments, the vehicle system 100 is provided with an engine coolant flow sensor configured to sense the rate of flow of coolant entering the engine. The coolant flow rate may be proportional to the coolant pressure and a fill signature or leak signature may be identified from engine coolant flow rate data provided by the coolant flow sensor using the same or similar methods as discussed above. In yet other embodiments, the vehicle system 100 is provided with one or both of an engine coolant inlet temperatures sensor 172 and an engine coolant outlet temperature sensor 174. The rise in coolant temperature between the engine inlet port 126 and the engine outlet port 128 may also correspond to the coolant pressure and/or level of coolant in the system. As the coolant level falls, the coolant temperature rise through the engine may be expected to increase, while the coolant pressure decreases. A fill signature or leak signature may thus also be identified through analysis of the engine coolant temperature data. The coolant system 120 may also include coolant level sensor 134. The coolant level sensor 134 may include one or more sensors configured to detect the level of coolant in the coolant reserve 124. The coolant level may be expected to decrease as coolant leaks from the system, and rise when coolant is added to the system, thus assisting with the identification of both fill and leak signatures. In various embodiments, the coolant pressure, the coolant flow rate, the coolant level, and the coolant temperature may be sensed and used either alone or in combination to identify fill signatures or leak signatures indicating that the coolant system 120 is losing coolant and may require maintenance. Other engine sensors corresponding to engine temperatures, such as the engine lubrication temperature, may also be monitored and compared with coolant pressure data to assist in identifying or diagnosing coolant leaks in the system.

In some embodiments, a plurality of fill signatures, leak signatures, or both are identified during a monitoring period. For example, fill signatures may be counted during the monitoring period. If the number of fill signatures exceeds a predetermined threshold for the monitoring period, an alert or warning may be generated and the operator or control center notified of the potential coolant leak of the system. Similarly, leak signatures, or a combination of fill and leak signatures, may be counted over the monitoring period and compared to a threshold. In some embodiments, the frequency of occurrence of fill signature, leak signatures, or both may be monitored over the monitoring period. The frequency of occurrence may be used to detect the presence or severity of a coolant leak, and to assess the likelihood of the engine operating without a coolant related fault or shutdown. The monitoring period may be selected based on the type of engine or vehicle system. Additionally, two or more monitoring periods may be analyzed, such as to assess both short-term and long-term performance of the engine. In some embodiments, the monitoring period is selected based on the planned maintenance schedule of the engine. In other embodiments, the monitoring period is selected based on the type of engine and the expected duty cycle of the engine or vehicle system. In another embodiment, the monitoring period is measured in operating time of the engine, not including time that the engine is inactive. In one embodiment, fill signatures in the measured coolant pressure of a locomotive may be monitored over a period of at least 3 days, at least 7 days, or at least 14 days. If the number of fill signatures in the measured coolant pressure of the locomotive exceeds a predetermined threshold over the monitoring period, the locomotive operator or control center may notified of the coolant leak.

The historical engine and coolant system data may be stored in a database, including samples of coolant pressure data from earlier operation of the engine. Thus, a trend in coolant pressure may be detected and the trend may be used to determine the health of the engine. In one embodiment, engine inlet coolant pressure data may be stored in a database, including historical engine data. For example, the database may be stored in memory 154 of controller 150. As another example, the database may be stored at a site remote from the rail vehicle 106. For example, historical data may be encapsulated in a message and transmitted with the communications system 190. In this manner, a command center may monitor the health of the engine in real-time. For example, the command center may perform steps to diagnose the condition of the engine and, if necessary, issue instructions to the operator regarding further operation of the engine. Further, the command center may schedule maintenance and deploy healthy locomotives and maintenance crews in a manner to optimize capital investment. Historical cooling system data may be further used to evaluate the health of the engine before and after engine service, engine modifications, and engine component change-outs.

In one embodiment, a coolant leak may be reported to the locomotive operating crew via the display 180. Once notified, the operator may adjust operation of the rail vehicle 106 to reduce the potential of further degradation of the engine. In one embodiment, a message indicating a potential fault may be transmitted with the communications system 190 to a command center. Further, the severity of the potential fault may be reported. For example, diagnosing a coolant leak based on one or more identified fill signatures in the engine coolant pressure data may allow a leak to be detected earlier than with prior methods. Thus, the engine may continue to operate when a potential coolant leak is diagnosed, provided that the engine is still receiving sufficient cooling. If the coolant is determined to be insufficient, such as by excessive temperature measurements or insufficient coolant pressure, it may be desirable to shutdown the engine or schedule prompt maintenance. In one embodiment, the severity of a coolant leak may be determined by the frequency of fill signatures identified or by the rate of change of coolant pressure exceeding a threshold value. In any event, identifying a coolant leak before the engine coolant is depleted may allow maintenance and repairs to be scheduled at a more desirable time and reduce unexpected road failures of the vehicle.

The system may also generate an alert based on the diagnosed condition of the engine. In one embodiment, the potential coolant leak may be reported to a locomotive operating crew via the display 180, and the operator may adjust operation of the rail vehicle 106 to reduce the potential of further degradation. In one embodiment, a message diagnosing the potential leak may be transmitted with the communications system 190 to a command center. For example, when a coolant leak is diagnosed, the operator may choose to reduce the engine speed to avoid exceeding permissible temperature limits. Alternatively, in some systems, the operator may be capable of at least partially refilling the coolant system to facilitate continued operation until the vehicle can be serviced.

In some embodiments, a request to schedule service may be sent, such as by a message sent via the communications system 190, for example. Further, by sending information on the potential coolant leak and the severity of the leak, down-time of the rail vehicle 106 may be reduced. For example, service may be scheduled for the rail vehicle 106 according to the severity of the potential leak and availability of maintenance crews. Down-time may be further reduced by prompting an operator to refill the engine coolant or by derating power of the engine to avoid excessive temperatures and maintain operation of the engine until maintenance can be performed.

In some embodiments, the controller 150 of the vehicle system 100 may include instructions to calculate an operational confidence metric based on the measured engine inlet coolant pressure data. Using the coolant pressure profile, an operational confidence metric may be calculated corresponding to the likelihood that the engine may be operated under standard conditions for a given period of time without a coolant leak related fault. In various embodiments, the operational confidence metric may be a quantitative or qualitative assessment, and may be an absolute or relative measure. In one embodiment, the operational confidence metric may be a binary (e.g. yes/no) indication that the engine is expected to operate for at least three days based on an average duty cycle of for the engine.

The controller may include instructions configured to calculate the operational confidence metric based on an analysis of the coolant pressure profile for the engine. In one example, a coolant pressure profile for the engine is determined at one or more operating speeds of the engine. The coolant pressure profile may be analyzed to identify a rate of change of the engine inlet coolant pressure over time for the given operating condition of the engine. If the coolant pressure is declining, the controller may calculate an operational confidence metric as the time until the coolant pressure is expected to reach the warning level 214 or the critical level 216. In other examples, the coolant pressure profile may be analyzed to determine the frequency of fill signatures and the operational confidence metric may be the estimated period until a coolant refill is expected.

The controller may also use historical data for the engine and/or data from other engines in a fleet to calculate the operational confidence metric. In various embodiments, the operational confidence metric may be expressed as the number of days the engine may be expected to operate without failure. In other embodiments, the operational confidence metric may be a relative measure between two or more engines in a fleet, indicating that one engine is less likely that another to suffer a coolant leak related fault. Comparing multiple engines in a fleet may allow a control center to select engines that have a higher operational confidence for longer trips, while reserving the engines with lower operational confidence for shorter trips. Engines with an operational confidence metric below a threshold may be removed from active scheduling until maintenance has been performed.

Figure 4:
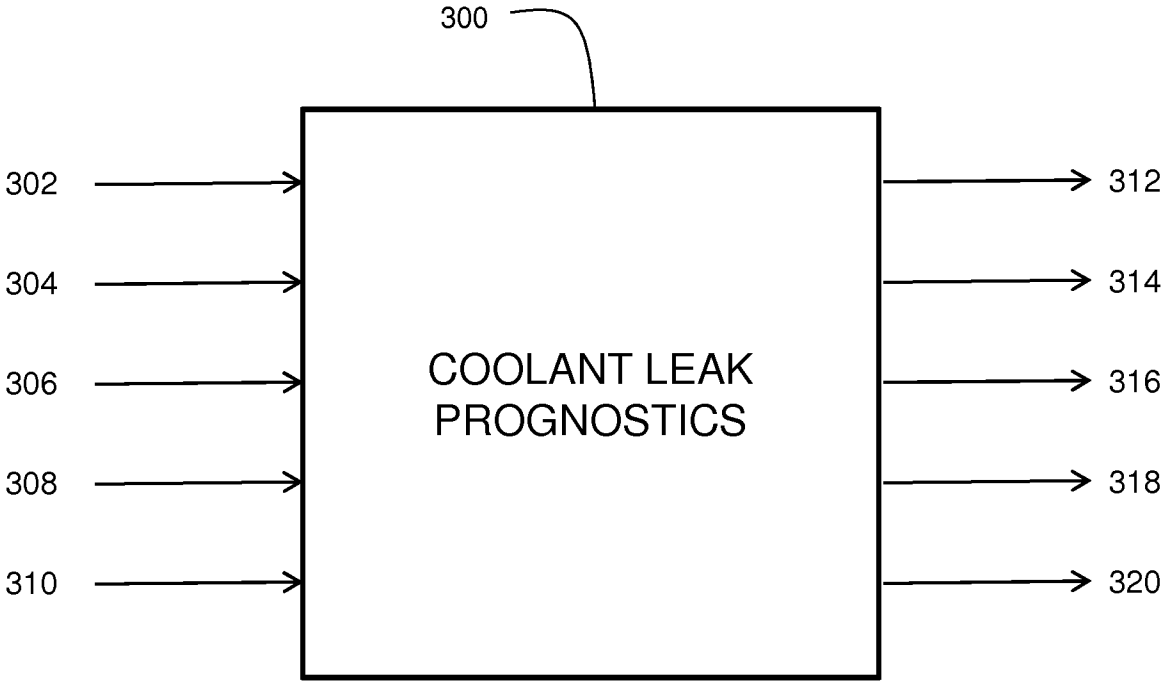
FIG. 4 is an illustration of an example embodiment of a coolant leak prognostics module.

In accordance with one embodiment, a coolant leak prognostics (CLP) module 300 is provided that implements one or more of the methods and system presently disclosed. The CLP may be implemented in hardware, software or a combination. In some embodiments, the CLP is implemented on the controller 150 of the vehicle system 100. For example, the CLP may be implemented as a state machine. As shown in FIG. 4, the CLP receives one or more inputs, such as engine coolant inlet pressure 302, engine speed 304, measured coolant level 306, engine coolant temperature 308, and/or engine lubrication temperature 310. The input data may be analyzed, compared with current or historical data from other engines, and processed to evaluate the health of the engine coolant system 120. The CLP may produce one or more outputs, such as identified fill signatures 312, identified leak signatures 314, alerts 316 or other alarms or warning messages, and/or operational confidence metrics 318, including the number of days until an expected coolant related fault or shutdown 320.

Various components of the engine 110 may degrade resulting in coolant leaks, such as, the coolant pump, the seals of the coolant pump and reserve tank, and various connections and piping between the elements of the coolant system 120. The CLP may assist the operator or maintenance personnel in diagnosing the source of coolant leaks. By comparing data from the coolant pressure sensor 170, engine speed sensor 160, coolant level sensor 134, and other components such as coolant and lube temperature sensors, the CLP may provide maintenance personnel guidance on where the coolant leak is occurring and aid in the diagnostic process.

In one embodiment, a test kit may be used for determining a condition of an engine based on identified fill signatures of a measured engine coolant pressure. For example, a test kit may include a controller that is operable to communicate with one or more engine coolant sensors and an engine rotational speed sensor. The controller may be further capable of correlating the measured engine coolant pressure and the measured rotational speed to identify a coolant pressure profile at a selected rotational speed over time. The controller may be further capable of identifying fill signatures in the coolant pressure profile and diagnosing a condition of the engine, such as a coolant leak, based on the identified fill signatures of the measured engine coolant pressure. The test kit may further include a communication link capable of interfacing with controller 150 and/or communications system 190. In one embodiment, the test kit transmits a message through communications link to a command center when a coolant leak or other condition of an engine is diagnosed.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Similarly, "free" may be used in combination with a term, and may include an insubstantial number, or trace amounts, while still being considered free of the modified term. Moreover, unless specifically stated otherwise, any use of the terms "first," "second," etc., do not denote any order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be." The terms "generator" and "alternator" are used interchangeably herein (however, it is recognized that one term or the other may be more appropriate depending on the application). The term "instructions" as used herein with respect to a controller or processor may refer to computer executable instructions.

The embodiments described herein are examples of articles, systems, and methods having elements corresponding to the elements of the invention recited in the claims. This written description may enable those of ordinary skill in the art to make and use embodiments having alternative elements that likewise correspond to the elements of the invention recited in the claims. The scope of the invention thus includes articles, systems and methods that do not differ from the literal language of the claims, and further includes other articles, systems and methods with insubstantial differences from the literal language of the claims. While only certain features and embodiments have been illustrated and described herein, many modifications and changes may occur to one of ordinary skill in the relevant art. The appended claims cover all such modifications and changes.

What is claimed is:

1. A method for an engine including a coolant pump comprising:

receiving engine speed data from the engine over a period of time;

receiving coolant pressure data from at least one coolant pressure sensor over the period of time;

correlating the engine speed data and the coolant pressure data using a computer controller to produce a pressure-speed relationship;

identifying one or more fill signatures using the computer controller based at least in part on the coolant pressure data over the period of time and the pressure-speed relationship, wherein the one or more fill signatures are identified based on an increasing pressure varying discontinuously along a pressure curve over the period of time indicating coolant has been added to the engine; and generating a signal based at least in part on the one or more fill signatures.

2. The method of claim 1, further comprising: driving the engine to a specified operating speed before measuring the coolant pressure data.

3. The method of claim 1, wherein each fill signature is further identified based at least in part on a measured coolant pressure among the coolant pressure data being no greater than a first pressure threshold for at least a first duration followed by the measured coolant pressure being no less than a second pressure threshold for at least a second duration, wherein the measured coolant pressure varies discontinuously at a point in time near an end of the first duration and near a beginning of the second duration.

4. A method for an engine including a coolant pump comprising:

receiving an engine coolant pressure over a time period at a computer controller to produce engine coolant pressure data;

receiving one or more rotational speeds of the engine over the time period at the computer controller to produce rotational speed data;

correlating the engine coolant pressure and the one or more rotational speeds using the computer controller to produce a pressure-speed relationship;

generating at least one coolant pressure profile corresponding to each of the one or more rotational speeds based at least in part on the pressure-speed relationship;

diagnosing a coolant leak of the engine based on a comparison of the engine coolant pressure data and the at least one coolant pressure profile; and transmitting a signal based at least in part on the coolant leak of the engine, wherein a computer controller is used to perform at least one of receiving the engine coolant pressure, receiving the one or more rotational speeds, correlating the engine coolant pressure and the one or more rotational speeds, generating the at least one coolant pressure profile, diagnosing the coolant leak, and transmitting the signal, and wherein the computer controller is located at a distance from the engine such that the computer controller is not aboard a vehicle mechanically coupled with the engine.

5. The method of claim 4, where the engine coolant pressure is at least one of an engine coolant inlet pressure and an engine coolant outlet pressure.

6. The method of claim 4, where the at least one coolant pressure profile includes a comparison of the engine coolant pressure and the one or more rotational speeds over time, and where diagnosing a coolant leak includes identifying a fill signature of the coolant pressure profile.

7. The method of claim 6, where identifying a fill signature includes identifying a measured low pressure condition prior to a measured standard pressure condition.

8. The method of claim 7, wherein the low pressure condition is a measured pressure less than or equal to a first pressure threshold and the standard pressure condition is a measured pressure within a desired operating range for the engine.

9. The method of claim 6, further comprising detecting a rate of change of the engine coolant pressure greater than or equal to a predetermined threshold, wherein identifying the fill signature is based at least in part on the rate of change.

10. The method of claim 6, further comprising:

identifying a plurality of fill signatures of the coolant pressure profile during a monitoring period; and counting the plurality of fill signatures to produce a fill signature count, where diagnosing the coolant leak is further based on the fill signature count exceeding a fill signature threshold.

11. The method of claim 4, where diagnosing a coolant leak includes identifying a decreasing pressure trend of the coolant pressure profile.

12. A vehicle system having an engine, comprising:

a coolant pressure sensor configured to measure engine coolant pressure of an engine coolant system during at least a first period of operation of the engine and a second period of operation of the engine;

an engine speed sensor configured to measure an engine speed during at least the first period of operation of the engine and the second period of operation of the engine; and a computer controller including instructions configured to:

create a coolant pressure profile that describes one or more pressure characteristics corresponding to the engine speed during the first period of operation of the engine;

identify a fill signature based on a comparison of the engine coolant pressure during the second period of operation of the engine and the coolant pressure profile, wherein the fill signature is identified at least in part based on a change in pressure associated with coolant added to the engine coolant system; and provide a signal based at least in part on the fill signature.

13. The vehicle system of claim 12, further comprising diagnosing a coolant leak based at least in part on the fill signature.

14. The vehicle system of claim 12, wherein the fill signature is further identified based at least in part on the coolant pressure profile being no greater than a first pressure threshold for at least a first duration followed by the coolant pressure profile being no less than a second pressure threshold for at least a second duration.

15. The vehicle system of claim 12, further comprising diagnosing a coolant leak by identifying a decreasing pressure trend of the coolant pressure profile.

16. The vehicle system of claim 12, further comprising:

a coolant temperature sensor configured to measure coolant temperature during operation of the engine;

where the controller further includes instructions to:

create a coolant temperature profile corresponding to a given engine speed, and diagnose a condition of the engine based on the coolant pressure profile and the coolant temperature profile.

17. The vehicle system of claim 12, further comprising instructions of the controller configured to calculate an operational confidence metric based on the coolant pressure profile.

18. A test kit comprising:

a computer controller including instructions configured to:

receive a coolant pressure associated with an engine system;

receive an engine speed corresponding to the coolant pressure;

compare the coolant pressure and engine speed to historical data to identify one or more fill signatures, the one or more fill signatures correspond to a discontinuous change in a pressure curve based at least in part on adding coolant to the engine system;

determine a condition of the engine system based on the one or more fill signatures of a measured engine coolant pressure; and provide a signal based at least in part on the condition.

19. The test kit of claim 18, wherein the controller is operable to communicate with one or more engine coolant sensors and an engine rotational speed sensor, and the controller is further capable of correlating the measured engine coolant pressure and a measured rotational speed to identify a coolant pressure profile at a selected rotational speed over time.

20. The method of claim 1, further comprising scheduling maintenance for the engine at least in part using the signal.

21. The method of claim 10, further comprising determining a leak severity based at least in part on the fill signature count.

22. The vehicle system of claim 12, further comprising instructions of the controller configured to compensate for expected pressure fluctuations at least in part by calculating a running average of the engine coolant pressure.

23. The vehicle system of claim 17, wherein the operational confidence metric is an estimated time period in which no coolant leak related fault will occur.

* * * * *